US011235441B2

(12) United States Patent
Yang et al.

(10) Patent No.: US 11,235,441 B2
(45) Date of Patent: Feb. 1, 2022

(54) WRENCH

(71) Applicants: Weikai Yang, Ruao Town (CN); Robert V. Albertson, Mound, MN (US); Jingrong Ye, Hangzhou (CN); Timothy Florian, Tarzana, CA (US)

(72) Inventors: Weikai Yang, Ruao Town (CN); Robert V. Albertson, Mound, MN (US); Jingrong Ye, Hangzhou (CN); Timothy Florian, Tarzana, CA (US)

(73) Assignee: ALBERTSON ENTERPRISES, LLC, Mound, MN (US)

( * ) Notice: Subject to any disclaimer, the term of this patent is extended or adjusted under 35 U.S.C. 154(b) by 176 days.

(21) Appl. No.: 16/687,063

(22) Filed: Nov. 18, 2019

(65) Prior Publication Data

US 2020/0246944 A1 Aug. 6, 2020

Related U.S. Application Data

(63) Continuation-in-part of application No. 16/433,203, filed on Jun. 6, 2019, now Pat. No. 10,668,600.

(60) Provisional application No. 62/802,120, filed on Feb. 6, 2019.

(51) Int. Cl.

| | |
|---|---|
| ***B25B 13/00*** | (2006.01) |
| ***B25B 13/46*** | (2006.01) |
| ***B25B 23/00*** | (2006.01) |

(52) U.S. Cl.

CPC ..... *B25B 13/462* (2013.01); *B25B 23/0007* (2013.01)

(58) Field of Classification Search

CPC ..... B25B 13/462; B25B 23/0007

USPC ..... 81/58.1, 179

See application file for complete search history.

(56) References Cited

U.S. PATENT DOCUMENTS

| | | | | |
|---|---|---|---|---|
| 835,448 | A | 11/1906 | Lowry et al. | |
| 1,511,226 | A | 10/1924 | Lawrence | |
| 1,609,086 | A | 10/1926 | Hurschman | |
| 2,529,947 | A | 10/1950 | Johnson | |
| 4,457,416 | A | 7/1984 | Kutzler | |
| 4,884,478 | A | 12/1989 | Lieser | |
| 6,036,130 | A | 3/2000 | Tiejen | |
| 6,253,646 | B1 | 7/2001 | Chang | |
| 6,295,899 | B1 * | 10/2001 | Lee | B25B 13/18 81/179 |
| 7,066,054 | B2 | 6/2006 | Liu | |
| D528,383 | S | 9/2006 | Albertson | |
| 8,215,207 | B2 | 7/2012 | Huang | |
| 8,516,926 | B1 | 8/2013 | Hsich | |
| 9,140,319 | B2 | 9/2015 | Buchanan | |
| 9,174,327 | B1 * | 11/2015 | Christensen | B25B 23/0007 |
| 9,327,389 | B2 | 5/2016 | Chen | |
| 9,770,813 | B2 | 9/2017 | Wang | |
| 9,902,049 | B2 | 2/2018 | Douglas | |
| 2004/0007097 | A1 | 1/2004 | Matsumoto | |
| 2004/0103760 | A1 | 6/2004 | Phillips | |

(Continued)

*Primary Examiner* — Joseph J Hail
*Assistant Examiner* — Shantese L McDonald
(74) *Attorney, Agent, or Firm* — Richard O. Bartz; Richard Jo Bartz

(57) ABSTRACT

A wrench has a head with an inside cylindrical wall surrounding a body with ramps. Cylindrical rollers located between the ramps and the cylindrical wall of the head are moved into wedging positions relative to the ramps and the inside cylindrical wall with permanent magnets located in a cage assembly anchored on the body.

21 Claims, 15 Drawing Sheets

(56) References Cited

U.S. PATENT DOCUMENTS

| | | | | |
|---|---|---|---|---|
| 2005/0076746 | A1 | 4/2005 | Hsien | |
| 2011/0209584 | A1 | 9/2011 | Suter | |
| 2014/0060257 | A1* | 3/2014 | Douglass | B25B 13/462 81/59.1 |
| 2015/0306745 | A1* | 10/2015 | Ross | B25B 13/462 81/59.1 |
| 2016/0129562 | A1 | 5/2016 | Douglass | |
| 2016/0271761 | A1 | 9/2016 | Chang | |
| 2018/0079055 | A1 | 2/2018 | Wang | |
| 2019/0076995 | A1* | 3/2019 | Albertson | B25B 13/462 |

* cited by examiner

WRENCH

CROSS REFERENCE TO RELATED APPLICATION

This application is a continuation-in-part of U.S. application Ser. No. 16/433,203 filed Jun. 6, 2019. Application Ser. No. 16/433,203 claims the benefit of U.S. Patent Application Ser. No. 62/802,120 filed Feb. 6, 2019.

FIELD OF THE INVENTION

The invention relates to hand tools for turning fasteners. The hand tools are wrenches with motion transmitting mechanisms operable to rotate fasteners in response to angular movements in one direction and prevent rotation of the fasteners in response to movements in a reverse direction.

BACKGROUND OF THE INVENTION

Ratchet wrenches having motion transmission mechanisms are used in automotive, industrial, farm shop and home applications to install and remove threaded fasteners. The motion transmission mechanisms used in ratchet wrenches have structures that are operable to transmit torque applied to the handles of the wrenches to driven bodies or spindles coupled to threaded fasteners and alternatively prevent the transfer of torque to the driven bodies or spindles. Ratchet wrench motion transmission mechanisms with a driving gear and a spring loaded pawl are used to rotate a fastener in one direction and prevent rotation of the fastener in a reverse direction without removing the wrench from the fastener. A large amount of angular movement of the handle of these ratchet wrenches are required to rotate fasteners. The required angular movement of the handle of the ratchet wrenches eliminates the use of the ratchet wrenches in confined environments. Ratchet wrenches having motion transmission mechanisms that operate with a minimum of back lash or lost motion during the reverse movement have cylindrical rollers that engage ramps on driven bodies and cylindrical walls of drive members. Springs, elastic members and magnets are interposed between the rollers and driven bodies to hold the rollers in wedging positions between the ramps and cylindrical walls of the drive members, such as the heads of wrenches.

Ratchet wrenches having cylindrical rollers retained in engagement with inclined ramps on driven bodies and cylindrical walls of the heads of the wrenches are shown and described in the following U.S. patents and U.S. published patent application.

C. B. Lowry and R. Bernhard in U.S. Pat. No. 835,448 discloses a wrench with a handle joined to a head having an internal cylindrical wall. A body with a plurality of steel inserts providing ramps for rollers retained in carriages. Each carriage retains two rollers in engagement with two ramps and adjacent cylindrical wall of the head. Coil springs engage the body and carriages to bias the carriages to hold the rollers in wedging engagement with the ramps and adjacent cylindrical wall of head whereby clockwise movement of the handle and head rotates the body and counterclockwise movement of the handle and head does not rotate the body. The carriage is not anchored to the body.

S. O. Lawrence in U.S. Pat. No. 1,511,226 discloses a wrench having a handle joined to a head. The head has a cylindrical inside surface surrounding an opening for accommodating a body. The outer portion of the body has a series of pockets accommodating cylindrical rollers that wedge between the body and head for rotation in one direction and to release the rollers to prevent the body from rotation in a reverse direction. In order to avoid lost motion of the rollers, flat springs engage the rollers to hold the rollers in wedging positions in the pockets.

F. W. Hottenroth, Jr. in U.S. Pat. No. 2,300,223 discloses a transmission mechanism having an annular member with inside ramps surrounding a cylindrical member. Wedging members shown as cylindrical rollers are located between the ramps and cylindrical member. Permanent magnets located in the annular member apply a magnetic force on the cylindrical rollers to hold the cylindrical rollers in wedging relation with the ramps and cylindrical member whereby on movement of the annular member in one arcuate direction rotates the cylindrical member and movement of the annular member in an arcuate direction opposite the one arcuate direction inhibits rotation of the cylindrical member.

R. A. Johnson in U.S. Pat. No. 2,529,947 discloses a roller clutch wrench having a head at the outer end of a handle. The head has an internal cylindrical surface surrounding an opening. A clutch body located in the opening has spaced notches with ramps. Ridges located between the ramps contact the cylindrical surface of the head. A roller located in each pocket is biased with a spring into wedging contact with the ramp and cylindrical surface of the head whereby clockwise movement of the handle and head rotates the clutch body and counterclockwise movement of the handle and head does not rotate the clutch body.

C. Proia in U.S. Pat. No. 5,390,773 discloses a clutch mechanism having a rotor surrounded by a cylindrical member having an inside cylindrical wall. The rotor has a plurality of surfaces or ramps. Cylindrical rollers engage the ramps and the inside wall of the cylindrical member. Magnets located on the ramps hold the cylindrical rollers in wedging positions whereby on rotation of the cylindrical wall in one rotational direction rotates the rotor and rotation of the cylindrical wall in a direction opposite the one direction inhibits rotation of the rotor.

C. T. Chang in U.S. Pat. No. 6,253,646 discloses a wrench having a handle joined to a head. The head has an inside circumferential wall having a plurality of arcuate recesses. A body with a cylindrical outer wall is located in an opening surrounded by wall with the recesses. Rollers located in the recesses engage the outer wall of the body to transmit torque from the head to the body during angular movement of the head and handle. A ring located on the body has C-shaped portions accommodating the rollers. A control device mounted on the head is used to rotate the ring to concurrently shift the ring to selectively move the rollers to clockwise and counterclockwise positions. A modification of the wrench has a head with a continuous inside cylindrical wall. The body has a plurality of ramps providing pockets for rollers. The ring biases the rollers into engagement with the inside cylindrical wall of the body whereby on angular movement of the handle in a clockwise direction the roller wedges between the ramps and inside cylindrical wall to rotate the body and on movement of the handle in a counterclockwise direction the rollers move to non-wedging locations in the pockets. The wrench is an improvement of a ratchet wrench having anti-reverse rollers and elastic members that bias the rollers into contact with ramps and a cylindrical wall of the head of the wrench.

M. Wang in U.S. Patent Application Publication No. 2018/0079055 discloses wrenches having unidirectional motion transmission mechanisms for rotating a nut or bolt head. Each wrench has a handle joined to a head having an internal cylindrical wall surrounding an opening. A body having inclined ramps is interposed in the opening and retained in the head. A cylindrical roller engages each ramp and adjacent cylindrical wall of the head. A spring between the body and roller biases the roller into contact with the ramp and adjacent cylindrical wall of the head. Movement of the handle and head in a clockwise direction wedges the roller into torque transmitting relationship with the ramp and cylindrical wall of the head thereby rotating the body. Movement of the handle and head in the opposite direction releases the torque transmitting relationship of the roller with respect to the ramp and cylindrical wall of the head whereby the body does not reverse rotate when the handle and head are moved in the reverse direction. One embodiment of the wrench has a holder having slots for accommodating the rollers. Elastic members or springs bias the rollers into contact with ramps and cylindrical wall of the head.

SUMMARY OF THE INVENTION

The invention relates to a hand tool used to rotate threaded fasteners, such as nuts and bolts. The hand tool is a roller type ratchet wrench having a handle joined to a head accommodating a spindle or body. The body has an opening accommodating a fastener to rotate the fastener with the body. A plurality of teeth or protrusions on the body have ramps inclined relative to an inside cylindrical wall of the head. Wedging members engage the ramps and cylindrical wall. An annular cage assembly anchored to the protrusions retains the wedging members in contiguous positions relative to the ramps on the body and the cylindrical wall of the head. Magnets associated with the cage assembly or body have magnetic forces that move and hold the wedging elements in operative engagements with the ramps and inside cylindrical wall of the head. Movement of the handle and head in one direction forces all the wedging members into driving or wedging relations with the ramps and the inside cylindrical wall of the head whereby the body and fastener held by the body are rotated. Movement of the handle and head in a direction reverse or opposite the one direction releases the wedging members from their wedging relations with the ramps and the inside cylindrical wall of the head to inhibit rotation of the body in a reverse direction. The wrench has a minimum of lost motion during its reverse direction so that the wrench can be used in confined environments.

DESCRIPTION OF THE INVENTION

Figure 1:
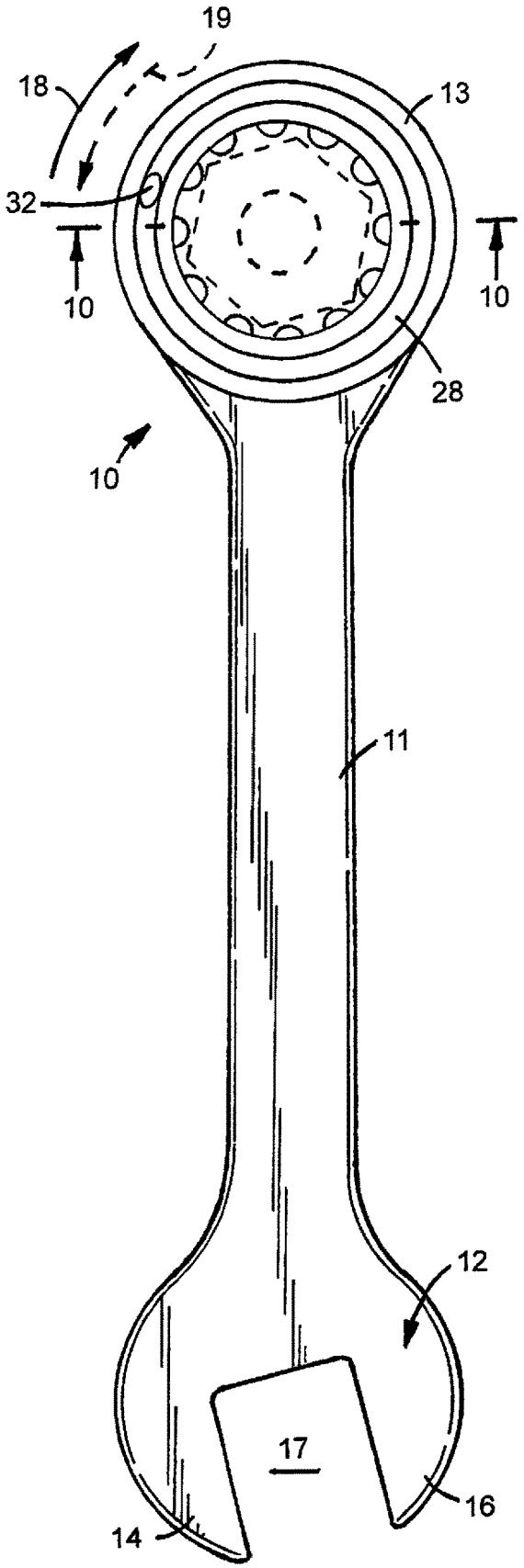
FIG. 1 is a front elevational view of a first embodiment of the combination box and roller wrench of the invention.
Figure 2:
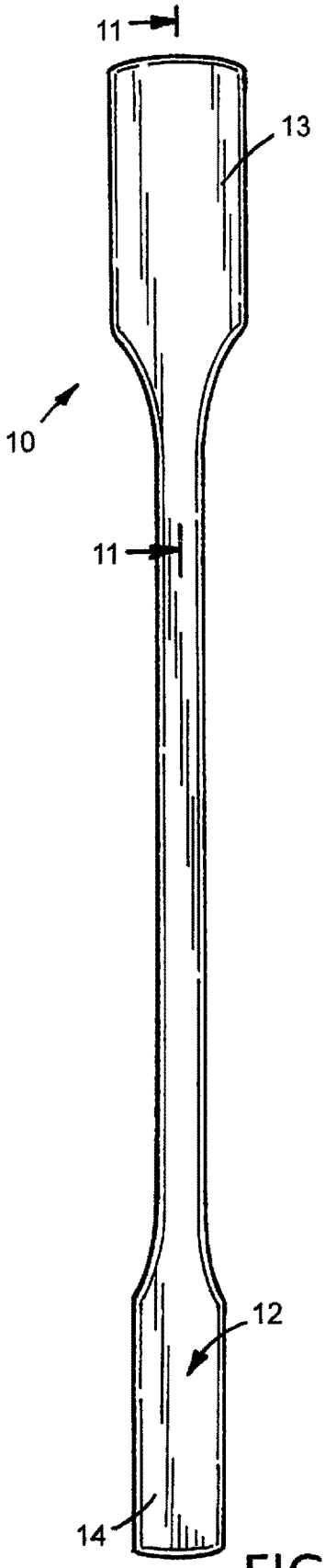
FIG. 2 is a left side elevational view of FIG. 1.

The hand tool, shown in FIGS. 1 to 13, is a first embodiment of a combination box and roller wrench 10. The wrench 10 is illustrated as one size of seven wrenches. The seven piece combination wrenches have metric sizes 8, 10, 12, 13, 14, 15 and 17 mm and SAE sizes 15/16, 3/8, 7/16, 1/2, 9/16, 5/8 and 3/4 inch. The wrenches can have additional sizes or less sizes. Wrench 10 comprises a linear handle 11, a box end 12 and a roller end or cylindrical head 13. Box end 12 has laterally spaced jaws 14 and 16 surrounding an opening 17 for accommodating a conventional nut or bolt or screw head. Opening 17 can have a width corresponding to the size of the inside of head 13. Handle 11, box end 12 and head 13 are a one-piece metal structure. Head 13 can be pivotally connected to an end of handle 11 to provide a flex-head combination wrench. In use, head 13 engages a fastener 18, such as a nut or head of a bolt or screw. As shown in FIG. 1, when handle 11 is angularly turned clockwise, shown by arrow 19, a right hand fastener 18 is threaded on to a threaded member. Turning handle 11 in a counterclockwise direction, shown by arrow 19, turns the fastener off of the threaded member.

Figure 10:
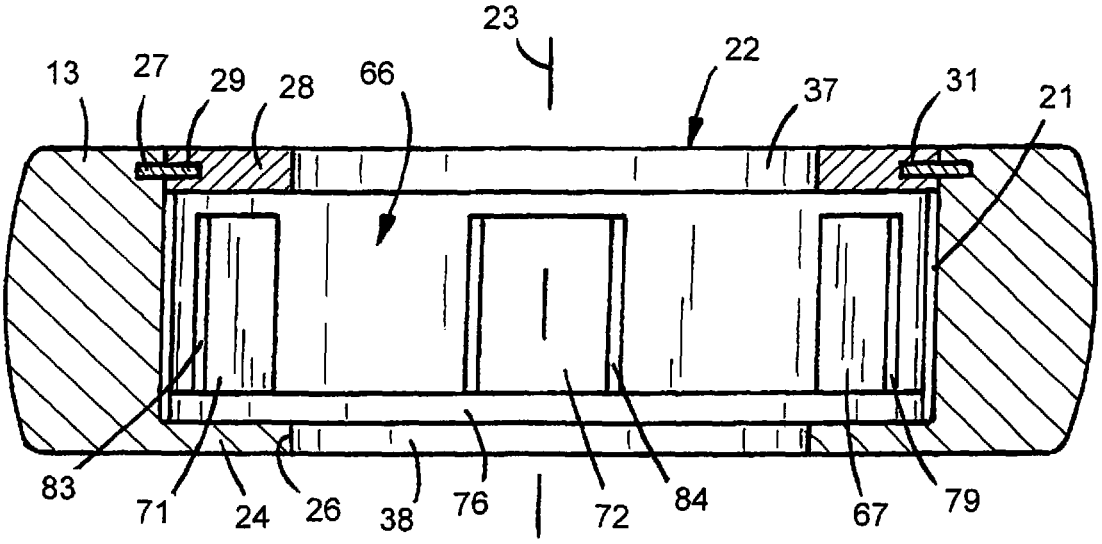
FIG. 10 is an enlarged sectional view taken along the line 10-10 of FIG. 1.

As shown in FIGS. 1 and 10, head 13 is a generally cylindrical member having flat top and bottom surfaces and an inside cylindrical wall 21 surrounding an opening 34 accommodating a driven member or body 22. Wall 21 has a continuous cylindrical surface concentric with the axis 23 of head 13. Head 13 includes an annular lip or flange 24 surrounding an opening 38. The upper section of cylindrical wall 21 has an annular groove or recess 27. A flat annular member or ring 28 is attached to head 13 with a C-shaped spring 29. Spring 29 extends into groove 27 in head 13 and an annular groove 31 in ring 28. As shown in FIG. 1, ring 28 has an aperture 32 that allows the ring 28 and spring 29 to be contracted to allow C-spring 29 to be inserted into groove 27. Ring 28 engages body 22 to retain body 22 in a rotational relationship with head 13.

Figure 3:
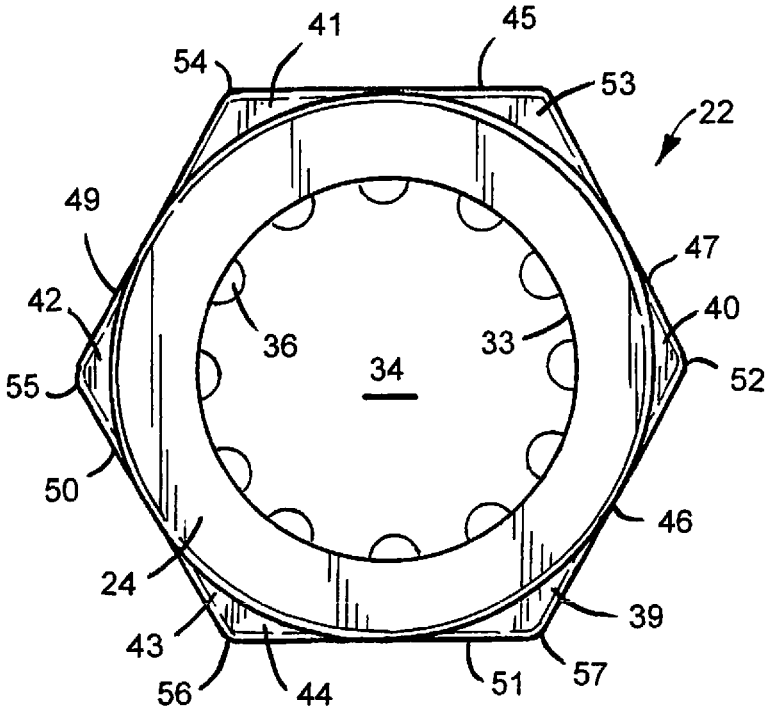
FIG. 3 is an enlarged top plan view of the driven body of the wrench of FIG. 1.
Figure 4:
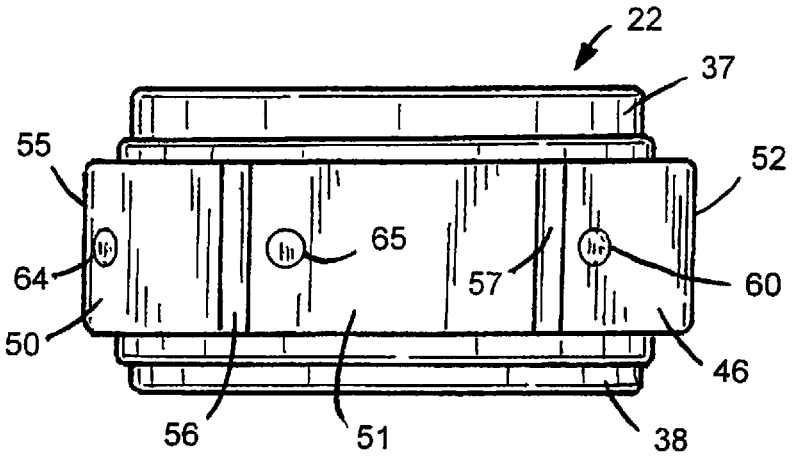
FIG. 4 is a bottom elevational view of FIG. 3.

Proceeding to FIGS. 3 and 4, body 22 has an inside cylindrical wall 33 surrounding an opening 34 to accommodate fastener 18. A plurality of circumferentially spaced elongated teeth or ribs 36 joined to wall 33 extend radially into opening 34. Adjacent ribs 36 are circumferentially spaced from each other providing grooves and recesses to accommodate corner portions of the hexagonal fastener 18 or corner portions of a square fastener to driveably couple body 22 with the fastener 18. The illustrated embodiment of wall 28, shown in FIGS. 1, 3, 6 and 11, has twelve ribs. The number, size and configuration of the ribs can vary. The inside wall 33 of body 22 can have a hexagonal shape without ribs to accommodate a hexagonal fastener.

As shown in FIGS. 4 and 10, body 22 has an upper cylindrical sleeve 37 and a lower cylindrical sleeve 38. Ring 28 surrounds sleeve 37. Sleeve 38 is located in opening 26 of lip 24. Sleeves 37 and 38 limit lateral movements of body 22 relative to head 13 and allow rotational movement of head 13 relative to body 22.

Body 22 has six protrusions or sections 39, 40, 41, 42, 43 and 44 having a perimeter hexagonal configuration. Protrusions 39 to 44 have flat rectangular outer faces or ramps 46, 47, 48, 49, 50 and 51. Each ramp 46 to 51 is tangent to a circle having a center at the axis 23 of body 22 and head 13. The ramps 46 to 51 have the same lengths and widths. The length of each ramp is two times its width. The ramps can have other dimensions. Ridges 52, 53, 54, 55, 56 and 57 are located at the outer ends of ramps 46 to 51. The ridges 52 to 58 are corners or apex members between adjacent ramps.

Figure 5:
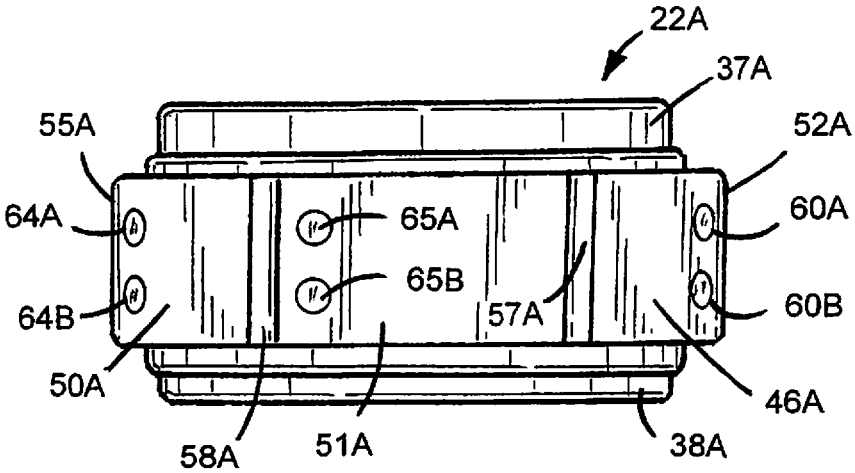
FIG. 5 is a bottom elevational view of a modification of the driven body of FIG. 3.
Figure 6:
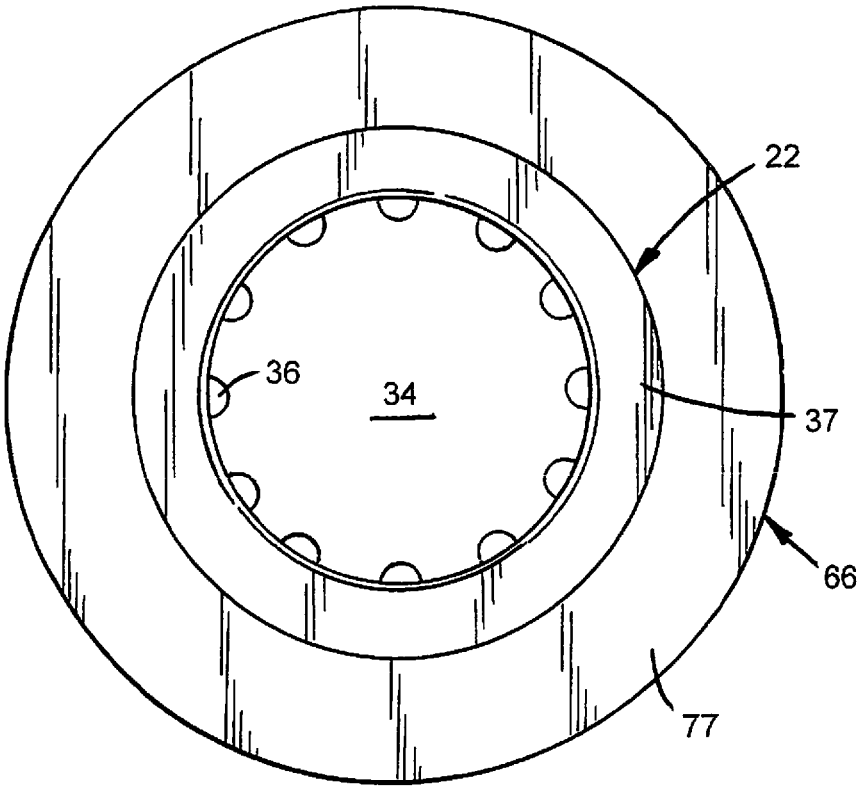
FIG. 6 is an enlarged top plan view of the combined annular cage assembly and driven body of the wrench of FIG. 1.
Figure 7:
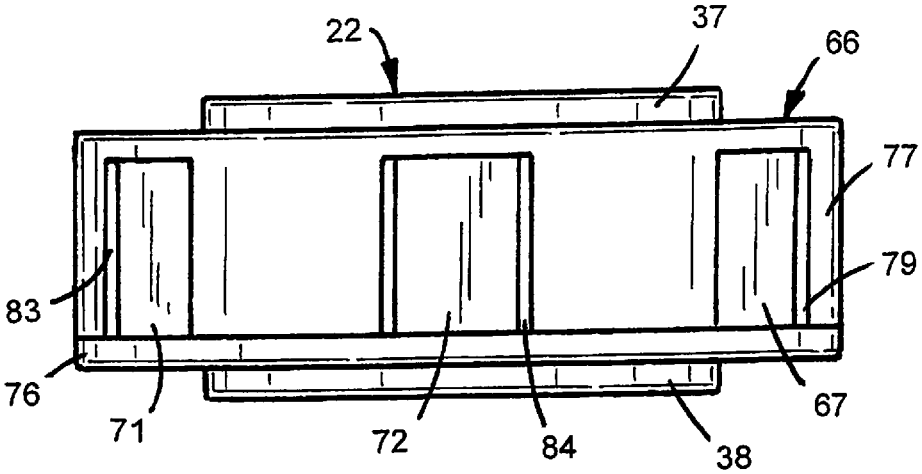
FIG. 7 is a bottom elevational view of FIG. 6.
Figure 11:
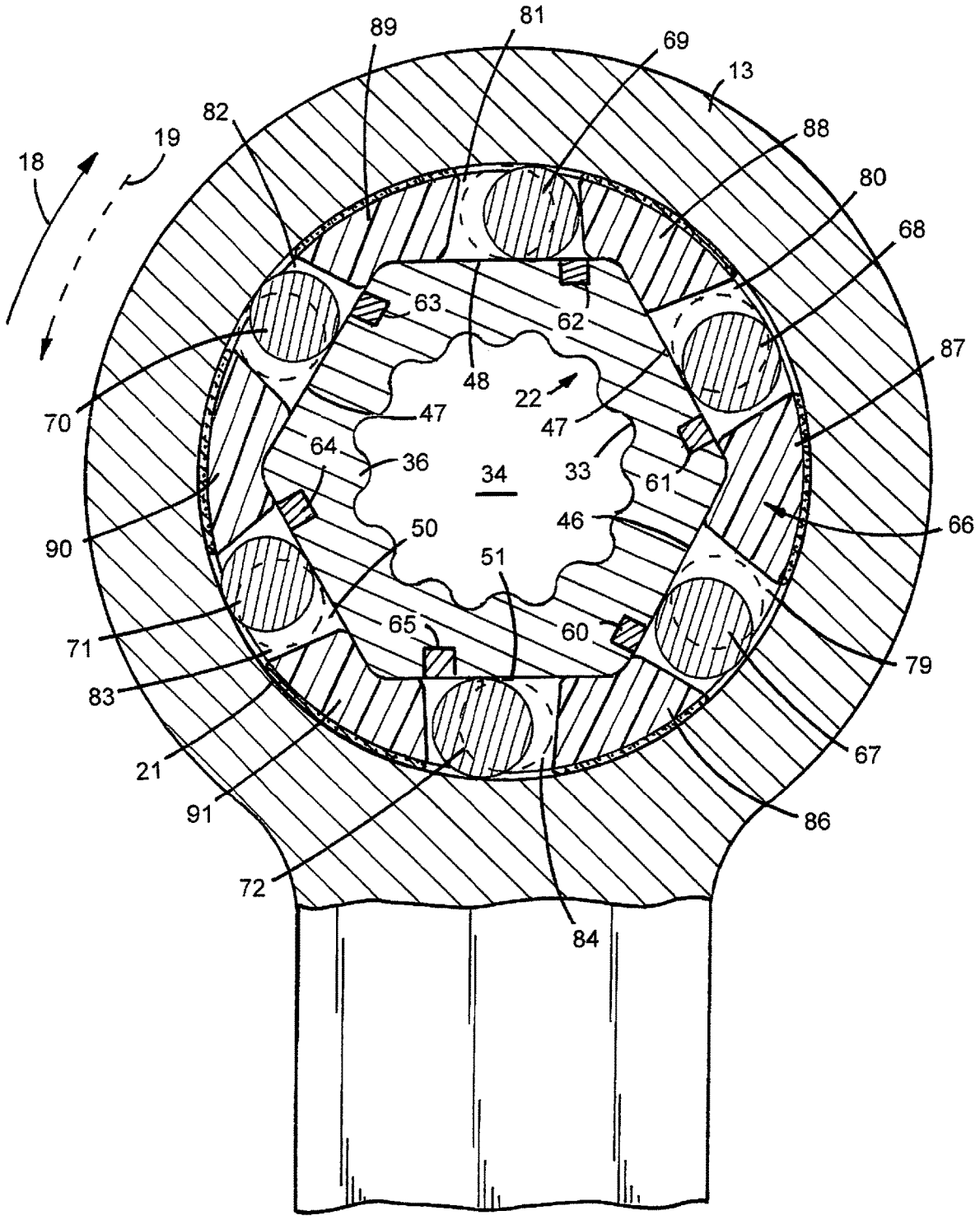
FIG. 11 is an enlarged sectional view taken along the line 11-11 of FIG. 2.

As shown in FIGS. 4 and 11, permanent magnets 60, 61, 62, 63, 64 and 65 are mounted on body 22. Magnets 60 to 65 are rare earth magnets having cylindrical configurations located in recesses in ramps 46 to 51. Examples of the permanent magnets are neodymium cylinder magnets, grade N52. The magnets are coated with nickel and copper to protect them from corrosion and to strengthen the magnet material. Other coatings can be used including epoxy to cover the magnetic material. The rare earth magnets having a high resistance to demagnetization and maintain a constant magnetic force for extended periods of time. Magnets 60 to 65 are located in recesses in the forward or proximal ends of ramps 46 to 51. An epoxy or adhesive can be used to retain the magnets on the body. As shown in FIG. 4, a single magnet is retained in each ramp. FIG. 5 shows a body 22A having two magnets 60A, 60B, 64A, 64B, 65A, 65B, retained in ramps 46A, 50A and 51A. Body 22A has the same structure as body 22 with reference numbers for corresponding structure identified with the same reference numbers having the suffix A.

Body 22, shown in FIGS. 6, 7, 10 and 11, is surrounded with an annular cage assembly or sleeve retainer 66 accommodating a plurality of wedging members 67, 68, 69, 70, 71 and 72. Cage assembly 66 is a cylindrical non-magnetic member. A plastic, such as polyoxymethylene or high density polyethylene, is an example of material for the cage assembly 66. Other materials including non-magnetic metals can be used for cage assembly 66. The wedging members comprise ferrous metal cylindrical rollers, such as steel cylinders. A cylindrical roller 67, shown in FIGS. 8 and 9, has a continuous cylindrical outside wall 73 and flat and circular end walls 74 and 76. End walls 74 and 76 have flat parallel surfaces. The axial length of roller 67 is greater than its diameter. The length to diameter ratio of the rollers can vary with the size of the wrench 10. Wedging members 68, 69, 70, 71 and 72 have the same dimensions as roller 62. The wedging members can have other configurations, such as oval, elliptical and polyhedral. The number of wedging members corresponds to the number of ramps on body 22.

Figure 12:
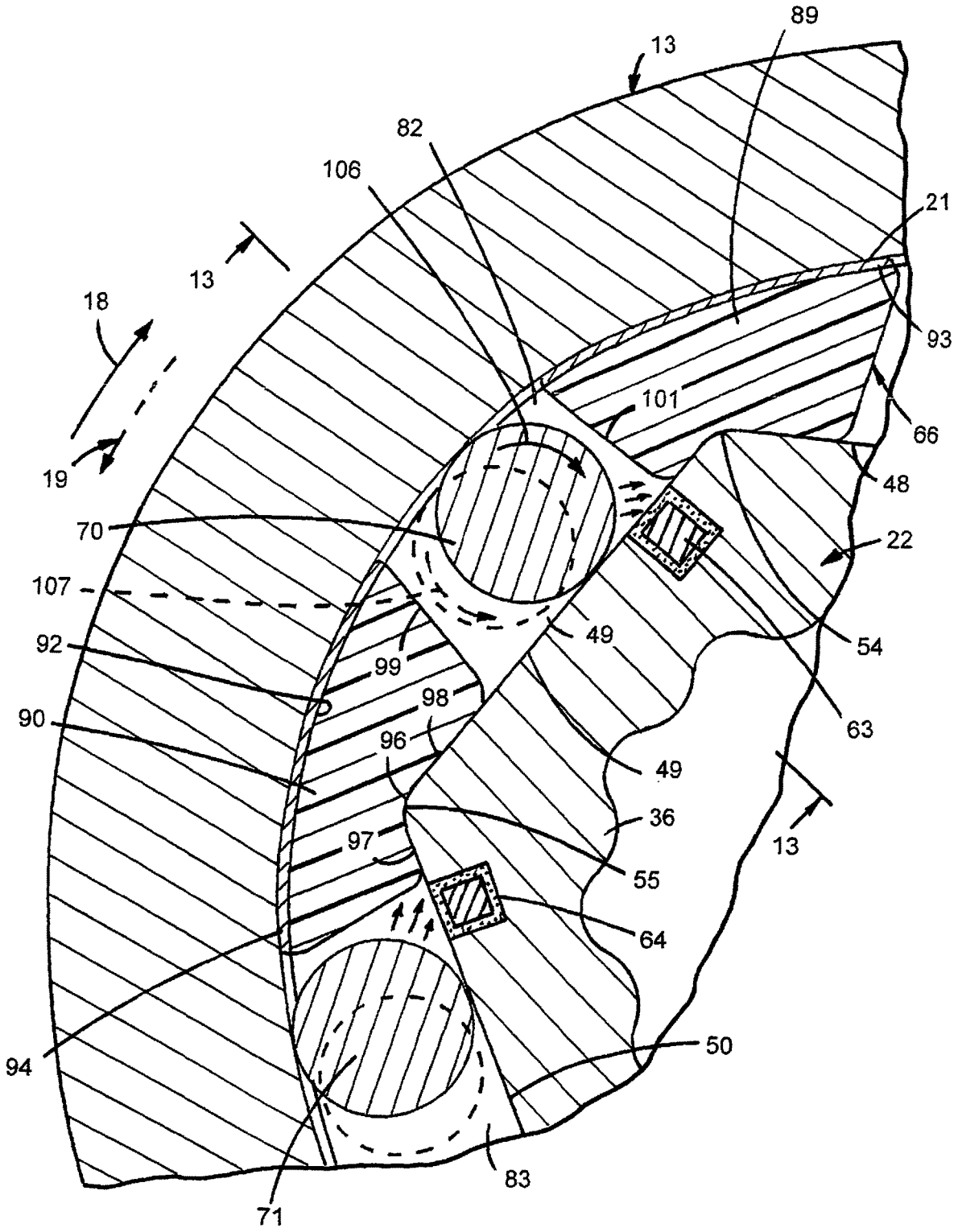
FIG. 12 is an enlarged section of FIG. 11.
Figure 13:
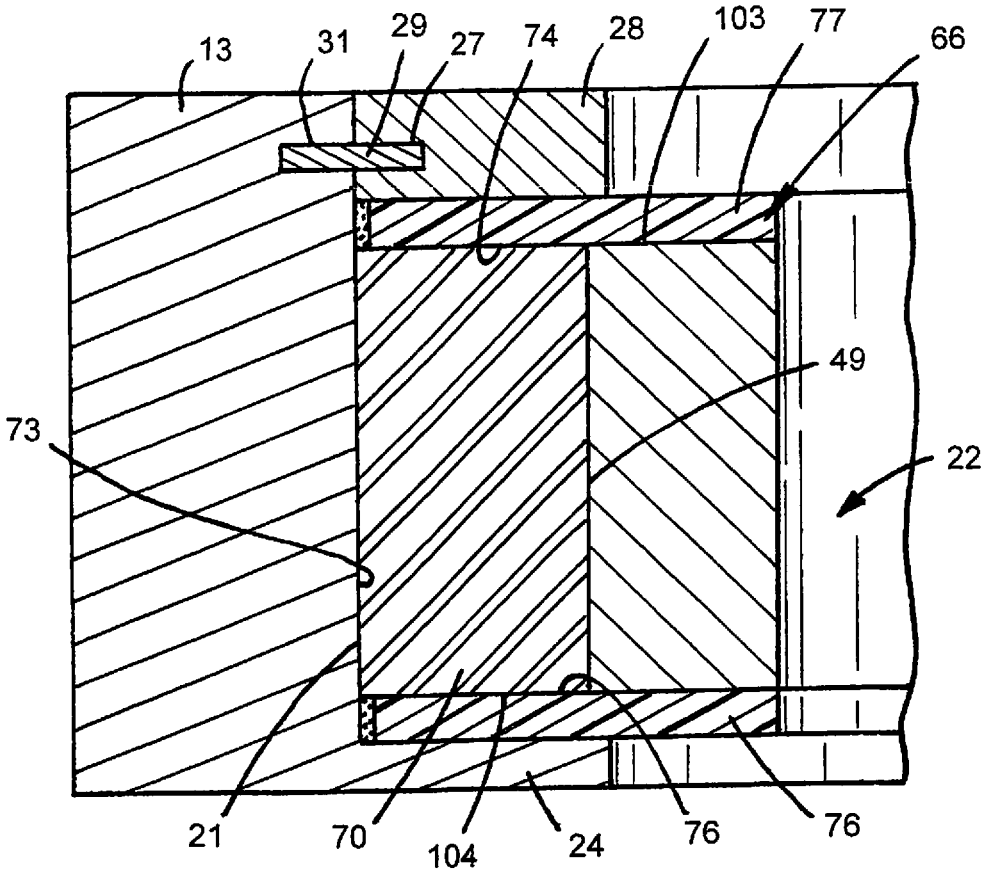
FIG. 13 is a sectional view taken along the line 13-13 of FIG. 12.

Cage assembly 66 has a first annular member 77 joined to a second annular member 78. Annular member 77 has a plurality of axial slots or rectangular openings 79, 80, 81, 82, 83 and 84 circumferentially spaced around annular member 77. Six openings are illustrated in FIG. 11. The number of openings in annular member 77 can vary. The number of openings 79 to 84 corresponds with the number of ramps 46 to 51. Annular member 77 has six segments 86, 87, 88, 89, 90 and 91 circumferentially spaced around annular member 77. One of the openings 79 to 84 is located between each adjacent segment. Wedging members 68 to 72, shown as cylindrical rollers, located in openings 79 to 84 selectively engage and disengage inside cylindrical wall 21 and ramps 46 to 51. As shown in FIG. 12, segment 90 has an arcuate outside wall 92. Segment 89 also has an arcuate outside wall 93. Each segment 86 to 91 has an arcuate outside wall the same as arcuate outside walls 92 and 93. The arcuate outside walls 92 and 93 and the arcuate outside walls of segments 86 to 91 are located in contiguous relation relative to the cylindrical wall 21 of head 13. The arcuate outside walls of segments 86 to 91 are in close proximity with the inside wall 21 of head 13 to locate cage assembly 66 concentric with the axis 23 of head 18. A lubricant 94 is located as a film on the inside cylindrical wall 21 of head 13 or the outside arcuate walls of segments 86 to 91. For example, a molybdenum and polytetrafluoroethylene lubricant can be used to prevent rust, binding, sticking and squeaking during use of the wrench 10.

Proceeding to FIG. 12, segment 90 of cage assembly 66 has an inside obtuse angle recess or groove 96 accommodating the ridge 55 of body 22. Each segment 86 to 91 has an obtuse angle groove corresponding to groove 96 in segment 90. The ramp portions adjacent ridge 55 located in surface engagement with the inside walls 97 and 98 of segment 90 prevent rotation of cage assembly 66 relative to body 22 and position the locations of openings 79 to 84 relative to ramps 46 to 51. Cage assembly 66 is anchored on body 22 to prevent rotation of the cage assembly 66. Segment 90 has a side wall 99. Segment 89 has a side wall 101. Side walls 89 and 101 converge or taper outwardly and are circumferentially spaced from each other to provide opening 82. Adjacent segments have side walls corresponding to side walls 99 and 101 providing openings 79 to 84 in the cage assembly 66 for wedging members 68 to 72.

Figure 8:
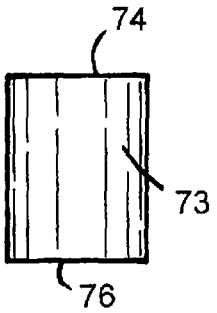
FIG. 8 is a front elevational view of a cylindrical roller for the wrench of FIG. 1.
Figure 9:
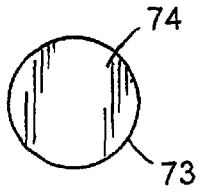
FIG. 9 is an end view of FIG. 8.

The wedging member 70, shown as a cylindrical roller in FIG. 8, has a side wall 73 located in linear engagement with the inside wall 21 of head 13 and ramp 49 of body 22. The linear engagement of wedging member 70 is continuous along the entire axial length of wedging member 70. The flat ends 74 and 76 of wedging element 70 located in sliding contact with flat surfaces 103 and 104 of cage assembly 66 maintain side wall 102 of wedging member 70 parallel to the side wall 21 of head 13 and ramp 49 of body 22. Wedging members 67 to 72 have the same structure as wedging member 70 and linear relation relative to the side wall 21 of head 13 and ramps 44 to 51.

Returning to FIG. 12, cage assembly segments 89 and 90 have side walls 101 and 99 on opposite sides of opening 82 that allow wedging member 70 to rotate, shown by arrow 106, and radially move from a contiguous position in opening 82 to a wedging or driving engagement with the cylindrical wall 21 of head 13 and ramp 49 when handle 11 and head 13 are moved in a clockwise direction, shown by arrow 18, whereby torque is applied to body 22 to rotate body 22 with head 13. Wedging member 70 rolls along ramp 49 clockwise away from the center of ramp 49 to drivably couple head 13 to body 22. When head 13 and handle 11 are turned in the reverse or counterclockwise direction wedging member 70 rotates in a counterclockwise direction, shown by broken line arrow 107, to a non-wedging or torque release position shown in broken lines whereby body 22 is not rotated. Wedging members 67 to 72 are concurrently moved in a clockwise direction to driving wedge engagement with side wall 21 of head 13 and ramps 46 to 51 when the head 13 and handle 11 are moved in a clockwise direction to rotate body 22. When the head 13 and handle 11 are moved in a counterclockwise direction wedging members 67 to 72 concurrently move to non-wedging or torque release positions without rotating body 22.

Figure 14:
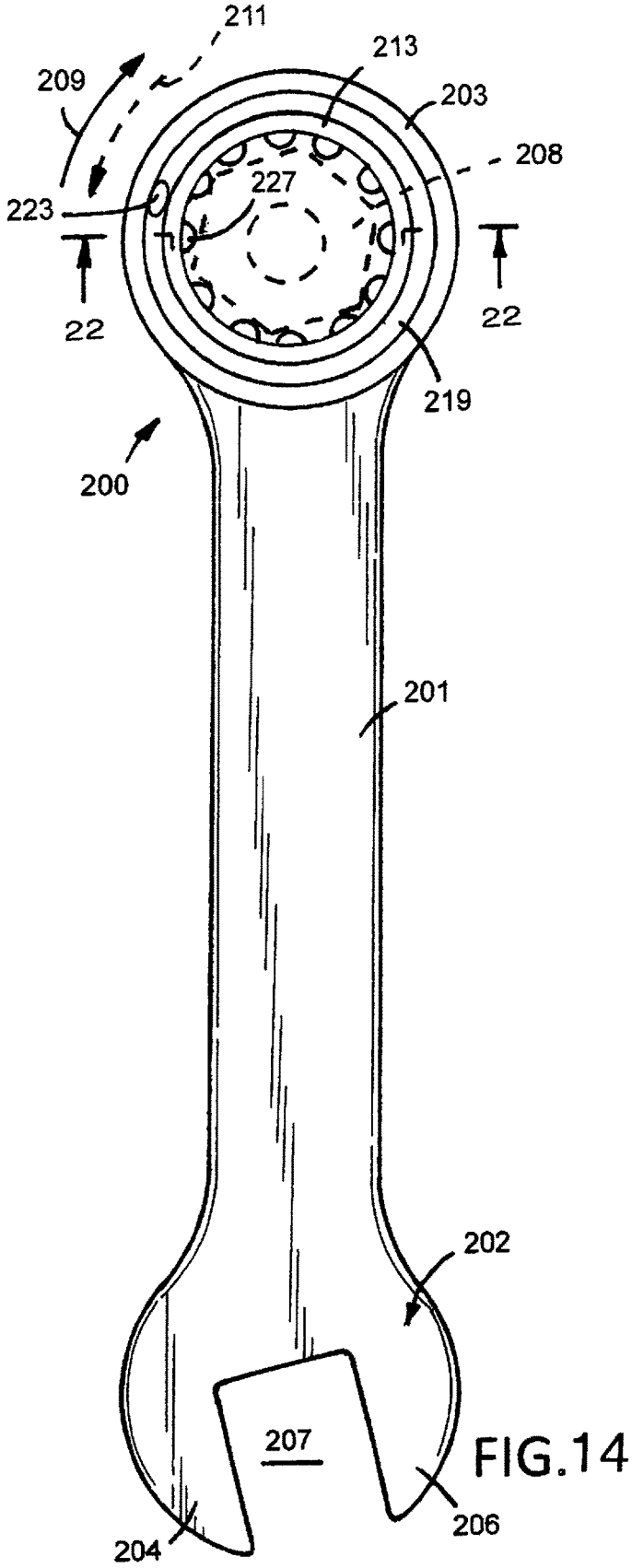
FIG. 14 is a front elevational view of a second embodiment of the combination box end and roller wrench of the invention.
Figure 15:
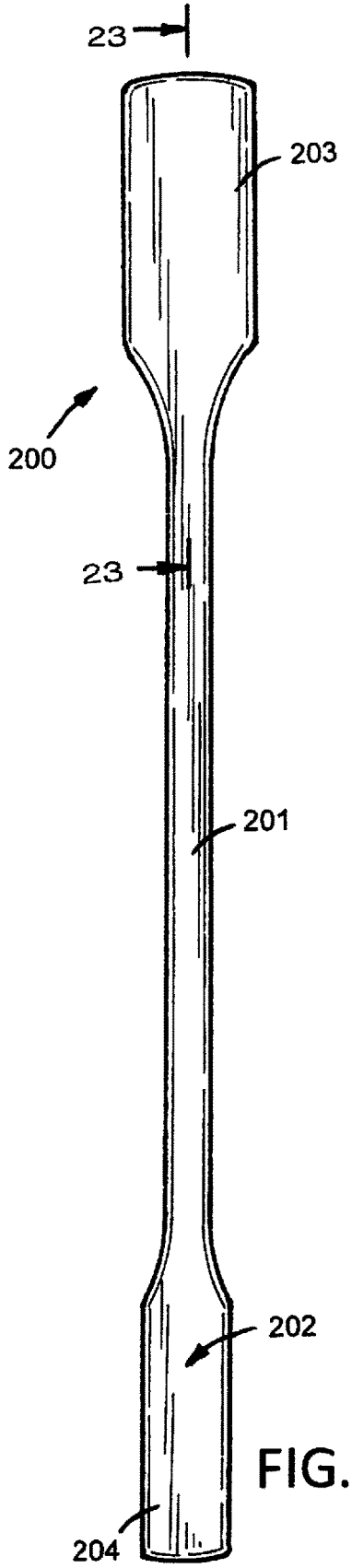
FIG. 15 is a left side elevational view of FIG. 14.

The hand tool, shown in FIGS. 14 to 27, is a second embodiment of a combination box and roller wrench 200. The wrench 200 is illustrated as one size of seven wrenches. The seven piece combination wrenches have metric sizes 8, 10, 12, 13, 14, 15 and 17 mm and SAE sizes 15/16, 3/8, 7/16, 1/2, 9/16, 5/8 and 3/4 inch. The wrenches can have additional sizes or less sizes. Wrench 200 comprises a linear handle 201, a box end 202 and a roller end or cylindrical head 203. Box end 202 has laterally spaced jaws 204 and 206 surrounding an opening 207 for accommodating a conventional nut or bolt or screw head. Handle 201, box end 202 and head 203 are a one-piece metal structure. Head 203 can be pivotally connected to an end of handle 201 to provide a flex-head combination wrench. In use, head 203 engages a fastener 208, such as a nut or head of a bolt or screw. As shown in FIG. 14, when handle 201 is angularly turned clockwise, shown by arrow 209, a right hand fastener 208 is threaded on to a threaded member. Turning handle 201 in a counterclockwise direction, shown by arrow 211, turns fastener off of the threaded member.

Figure 22:
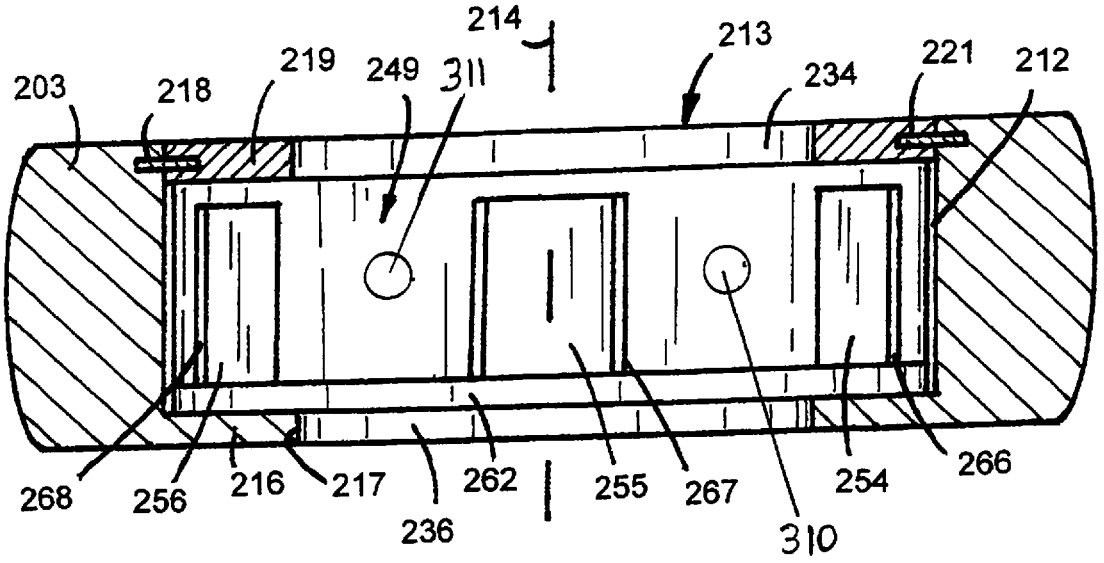
FIG. 22 is an enlarged sectional view taken along the line 22-22 of FIG. 14.
Figure 23:
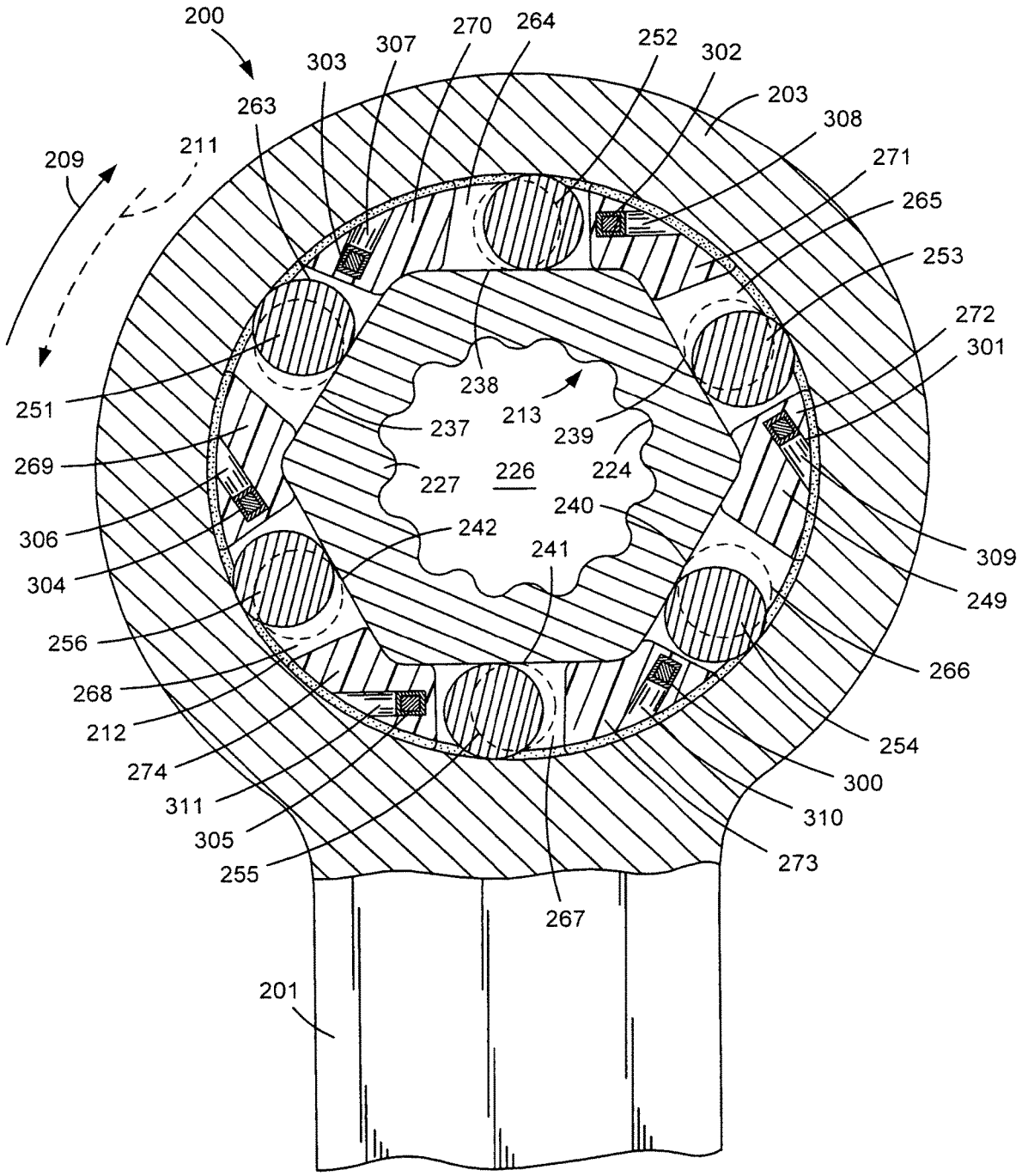
FIG. 23 is an enlarged section of FIG. 22.

As shown in FIGS. 14, 22 and 23, head 203 is a generally cylindrical member having flat top and bottom surfaces and a cylindrical inside wall 212 surrounding an opening 226 accommodating a driven member or body 213. Wall 212 has a continuous cylindrical inside surface concentric with the axis 214 of head 203. Head 203 includes an annular lip or flange 216 surrounding an opening 217. The upper cylindrical inside wall 212 has an annular groove or recess 218. A flat annular member or ring 219 is attached to head 203 with a C-shaped spring 221. Spring 221 extends into groove 218 in head 203 and an annular groove 222 in ring 219. As shown in FIG. 14, ring 219 has an aperture 223 that allows the ring 219 to be contracted to allow the C-spring to be inserted into groove 218. Ring 219 engages metal spindle or body 213 to retain body 213 in a rotational relationship with head 203.

Figure 16:
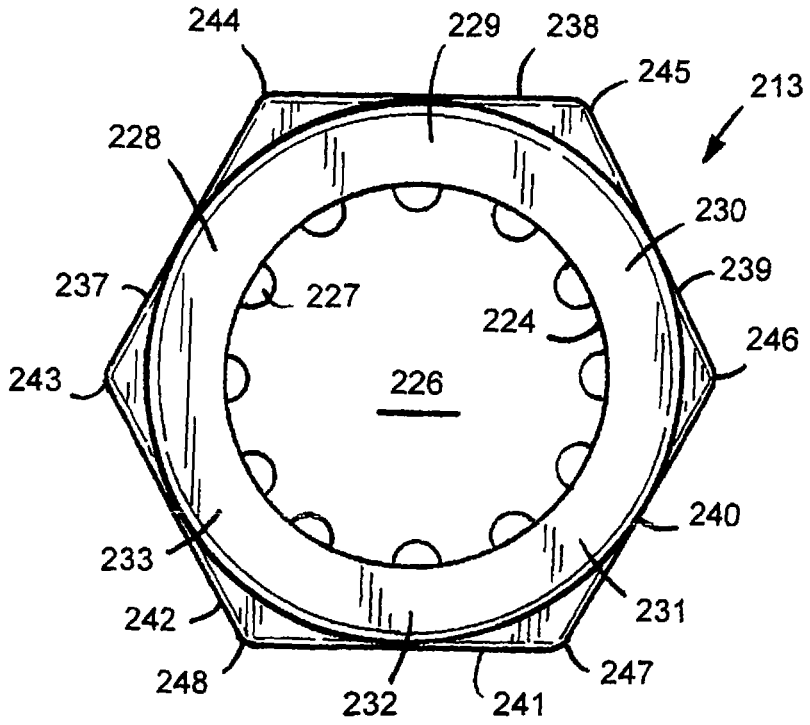
FIG. 16 is an enlarged top plan view of the driven body of the wrench of FIG. 14.
Figure 17:
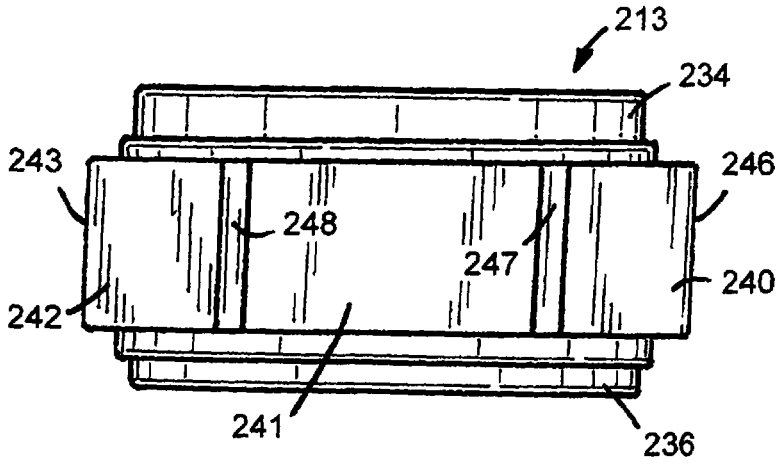
FIG. 17 is a bottom elevational view of FIG. 16.
Figure 18:
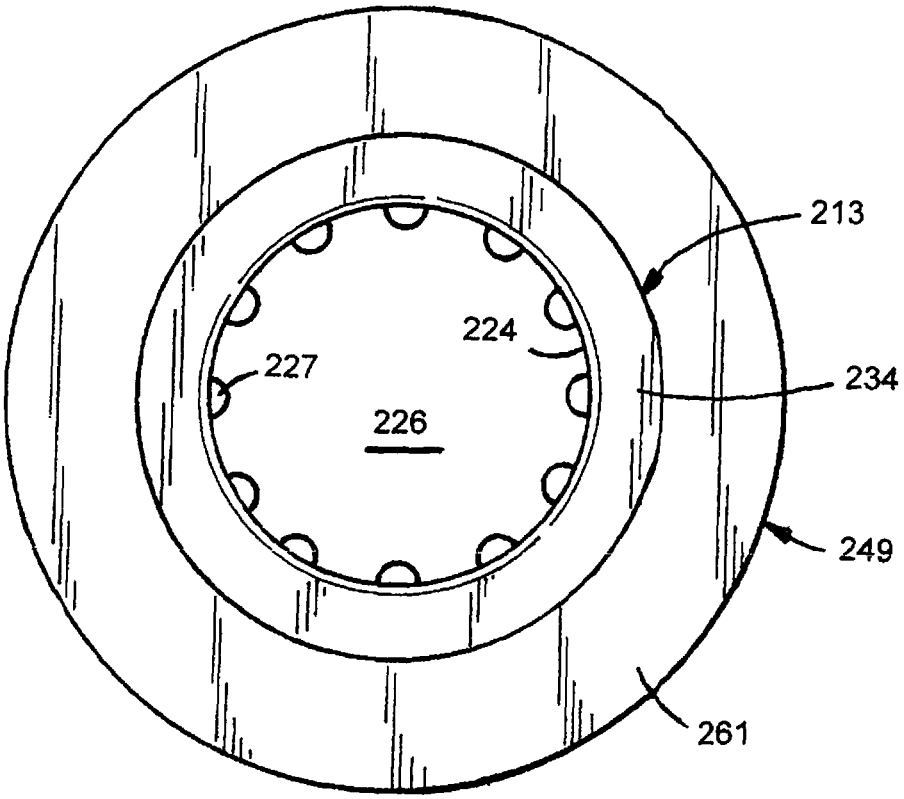
FIG. 18 is an enlarged top plan view of the combined annular cage assembly and driven body of the wrench of FIG. 14.
Figure 19:
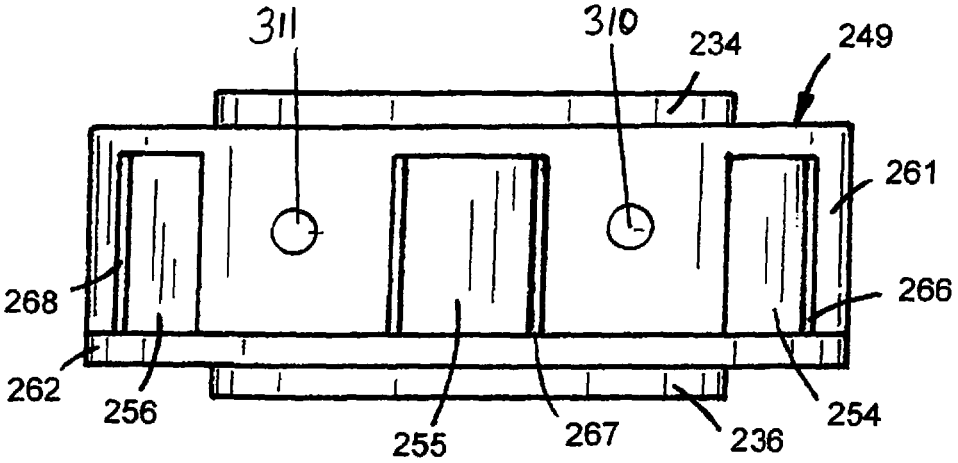
FIG. 19 is a bottom elevational view of FIG. 18.

Proceeding to FIGS. 16 and 17, body 213 has an inside cylindrical wall 224 surrounding opening 226 to accommodate fastener 208. A plurality of circumferentially spaced elongated teeth or ribs 227 joined to wall 224 extend radially into opening 226. Adjacent ribs 227 are circumferentially spaced from each other providing grooves and recesses to accommodate corner portions of the hexagonal fastener 208 or corner portions of a square fastener to driveably couple body 213 with the fastener. The illustrated embodiment of wall 224, shown in FIGS. 14, 16, 18 and 23, has twelve ribs. The number, size and configuration of the ribs can vary. The inside wall 224 of body 213 can have a hexagonal shape without ribs to accommodate a hexagonal fastener.

As shown in FIGS. 16 and 17, body 213 has an upper cylindrical sleeve 234 and a lower cylindrical sleeve 236. Ring 219 surrounds sleeve 234. Sleeve 236 is located in opening 217 of lip 216. Sleeves 234 and 236 limit lateral movements of body 213 relative to head 203 and allow rotational movement of head 203 relative to body 213. Body 213 has six protrusions or sections 228, 229, 230, 231, 232 and 233 having a perimeter hexagonal configuration. Protrusions 228 to 233 have flat rectangular outer faces or ramps 237, 238, 239, 240, 241 and 242. Each ramp 237 to 242 is tangent to a circle having a center at the axis 214 of body 213 and head 203. The ramps 237 to 242 have the same lengths and widths. The length of each ramp is two times its width. The ramps can have other dimensions. Ridges 243, 244, 245, 246, 247 and 248 are located at the outer ends of ramps 237 to 242. The ridges 243 to 248 are corners or apex members between adjacent ramps.

Body 213, shown in FIGS. 18, 19, 22 and 23, is surrounded with an annular cage assembly or sleeve retainer 249 accommodating a plurality of wedging members 251, 252, 253, 254, 255 and 256. Cage assembly 249 is a cylindrical non-magnetic member. A plastic, such as polyoxymethylene or high density polyethylene, is an example of a material for cage assembly 249. Other materials including non-magnetic metals can be used for cage assembly 249. The wedging members comprise ferrous metal cylindrical rollers, such as steel rollers. A cylindrical roller 251, shown in FIGS. 20 and 21, has a continuous cylindrical outside wall 257 and flat and circular end walls 258 and 259. End walls 258 and 259 have flat parallel surfaces. The axial length of roller 251 is greater than its diameter. The length to diameter ratio of the rollers can vary with the size of the wrench 200. Rollers 252, 253, 254, 255 and 256 have the same dimensions as roller 251. The wedging members can have other configurations, such as oval, elliptical and polyhedral. The number of wedging members corresponds to the number of ramps on body 213.

Figure 24:
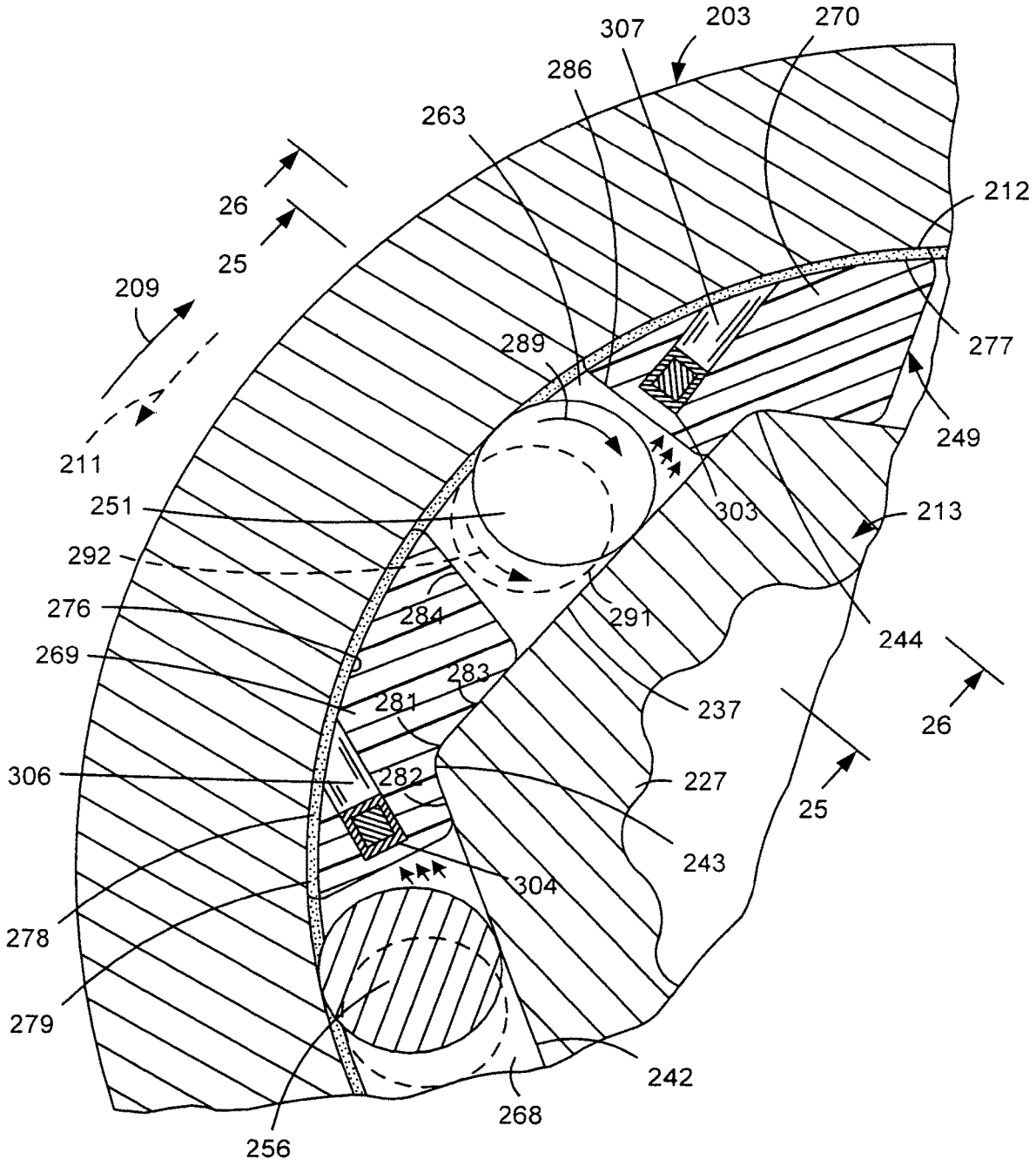
FIG. 24 is a sectional view taken along the line 24-24 of FIG. 23.
Figure 25:
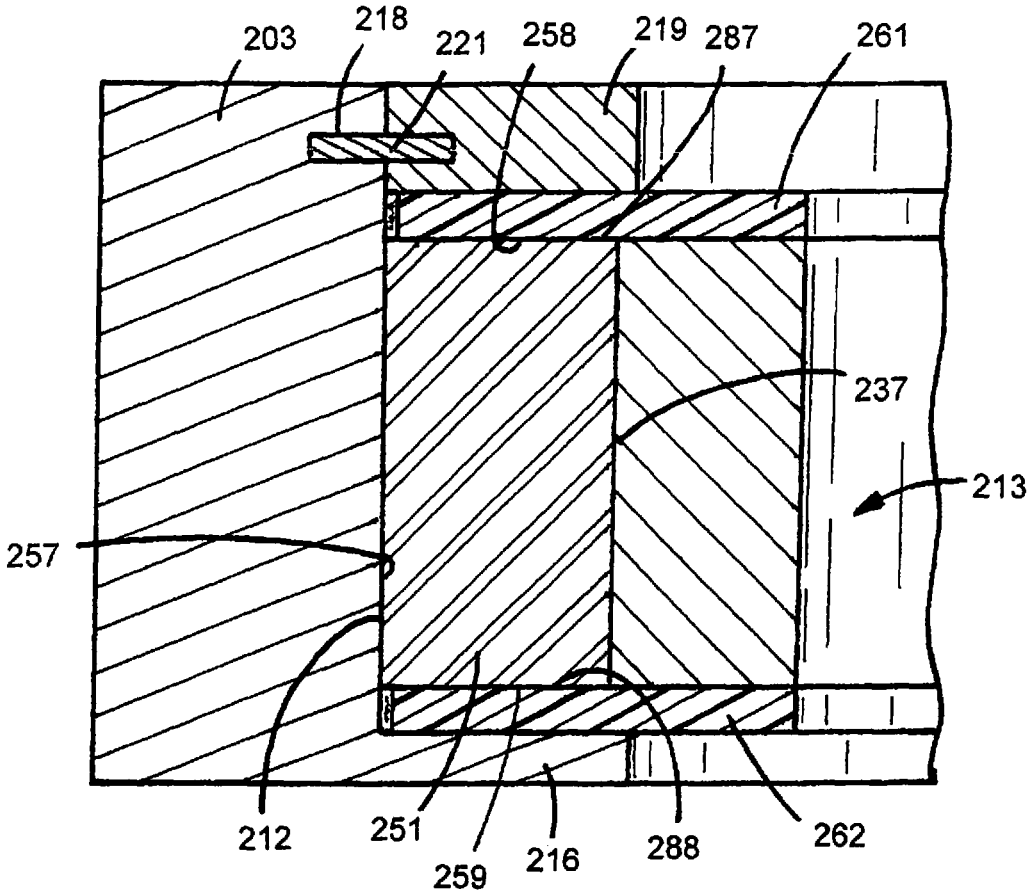
FIG. 25 is a sectional view taken along the line 25-25 of FIG. 23.

Cage assembly 249 has a first annular member 261 joined to a second annular member 262. Annular member 261 has a plurality of axial slots or rectangular openings 263, 264, 265, 266, 267 and 268 circumferentially spaced around annular member 261. Six openings are illustrated in FIG. 23. The number of openings in annular member 261 can vary. The number of openings 263 to 268 corresponds with the number of ramps 237 to 242. Annular member 261 has six segments 269, 270, 271, 272, 273 and 274 circumferentially spaced around annular member 261. One of the openings 263 to 268 is located between each adjacent segment. Wedging members 251 to 256, shown as cylindrical rollers, located in openings 263 to 268 selectively engage and disengage inside cylindrical wall 224 and ramps 237 to 242. As shown in FIG. 24, segment 269 has an arcuate outside wall 276. Segment 270 also has an arcuate outside wall 277. Each segment 271 to 274 has an arcuate outside wall the same as arcuate outside walls 276 and 277. The arcuate outside walls 276 and 277 and the arcuate outside walls of segments 271 to 274 are located in contiguous relation 278 relative to the cylindrical wall 212 of head 203. The arcuate outside walls of segments 269 to 274 are in close proximity with the inside wall 212 of head 203 to locate cage assembly 249 concentric with the axis of head 203. A lubricant 279 is located as a film on the inside cylindrical wall 212 of head 203 or in the outside arcuate walls of segments 269 to 274. For example, a molybdenum and polytetrafluoroethylene lubricant can be used to prevent rust, binding, sticking and squeaking during use of the wrench 200.

Proceeding to FIG. 24, segment 269 of cage assembly 249 has an inside obtuse angle recess or groove 281 accommodating the ridge 243 of body 213. Each segment 270 to 274 has an obtuse angle groove corresponding to groove 281 in segment 269. The ramp portions adjacent ridge 243 located in surface engagement with the inside walls 282 and 283 of segment 269 prevent rotation of cage assembly 249 relative to body 213 and position the locations of openings 263 to 268 relative to ramps 237 to 242. Cage assembly 249 is anchored on body 213. Segment 269 has a side wall 284. Segment 270 has a side wall 286. Side walls 284 and 286 converge or taper outwardly and are circumferentially spaced from each other to provide opening 263. Adjacent segments have side walls corresponding to side walls 284 and 286 providing openings 263 to 268 in the cage assembly 249 for wedging members 252 to 256.

Figure 20:
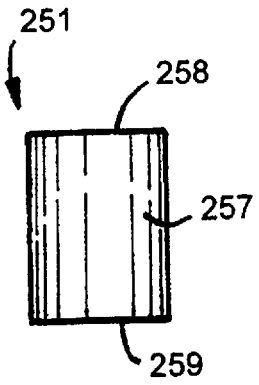
FIG. 20 is a front elevational view of a cylindrical roller for the wrench of FIG. 14.
Figure 21:
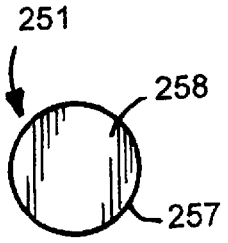
FIG. 21 is an end view of FIG. 20.

The wedging member 251, shown as a cylindrical roller in FIGS. 20 and 21, has a side wall 257 located in linear engagement with the inside wall 212 of head 203 and ramp 237 of body 213. The linear engagement of wedging member 251 is continuous along the entire axial length of wedging member 251. The flat ends 258 and 259 of wedging element 251 located in sliding contact with flat surfaces 287 and 288 of cage assembly 249 maintain side wall 257 of wedging member 251 parallel to the side wall 212 of head 203 and ramp 237 of body 213. Wedging members 252 to 256 have the same structure as wedging member 251 and linear relation relative to the side wall 212 of head 203 and ramps 238 to 242.

As shown in FIGS. 23 and 24, permanent magnets 300, 301, 302, 303, 304 and 305 attached to cage assembly 249 apply magnetic forces on wedging members 251 to 256 to simultaneously move the wedging members 251 to 256 up the ramps 237 to 242. The magnetic force holds the wedging members 251 to 256 in contiguous positions with the ramps 237 to 241 and cylindrical wall 212 of head 203. Movement of head 203 in a clockwise direction shown by arrow 209 locates all of the wedging members 251 to 256 in driving or wedging engagement with the side wall 212 of head 203 and ramps 237 to 242. The magnetic force of magnets 300 to 305 does not inhibit rotation of the wedging elements 251 to 256 or the concurrent movement of the wedging elements to the driving or wedging positions between the ramps and head. Magnets 300 to 305 are rare earth magnets having cylindrical configurations and the same magnetic attraction force. Magnets 300 to 305 are located in blind pockets or holes 306, 307, 308, 309, 310 and 311 in cage segments 269, 270, 271, 272, 273 and 274. An epoxy or adhesive can be used to retain magnets 300 to 305 on the segments 269 to 274. The magnets 300 to 305 can be molded into the segments 269 to 274. The magnets 300 to 305 can be located in the side walls of the segments 269 to 274 facing the wedging members 251 to 256. Examples of the permanent magnets are cylindrical neodymium magnets, grade N52. Each magnet is coated with nickel and copper to protect it from corrosion and to strengthen the magnetic material. The rare earth magnets have high resistance to demagnetization and maintain a constant magnetic force for extended periods of time.

Figure 26:
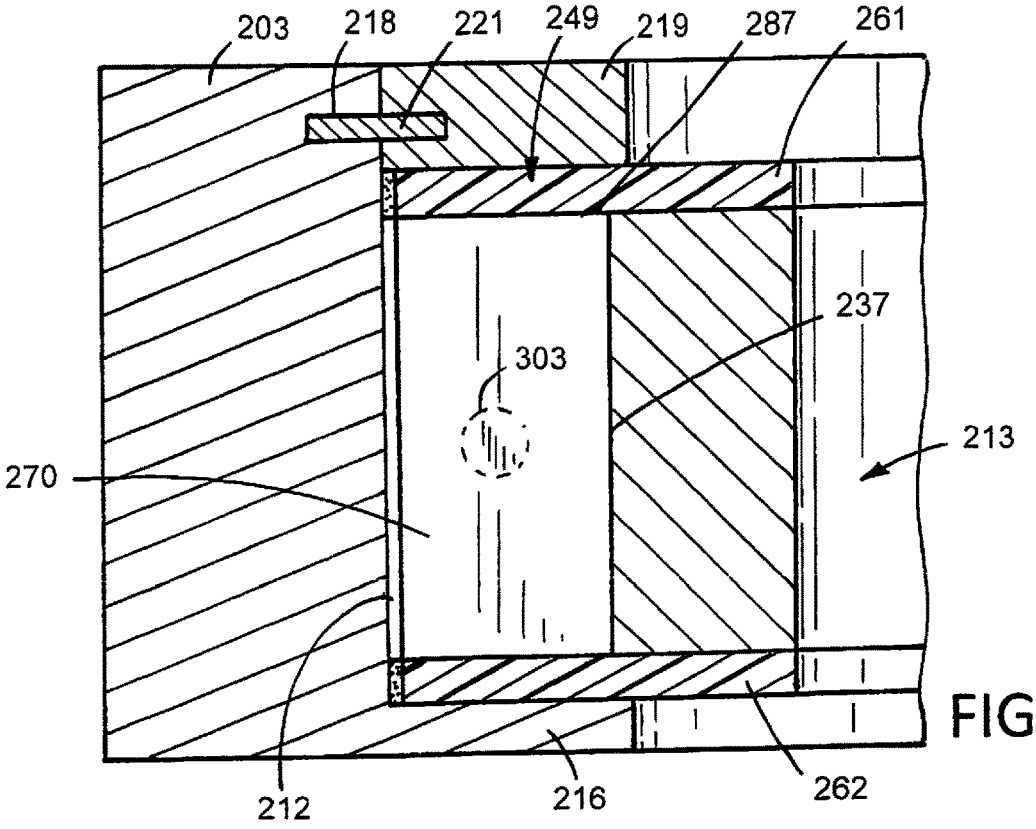
FIG. 26 is a sectional view taken along the line 26-26 of FIG. 24.
Figure 27:
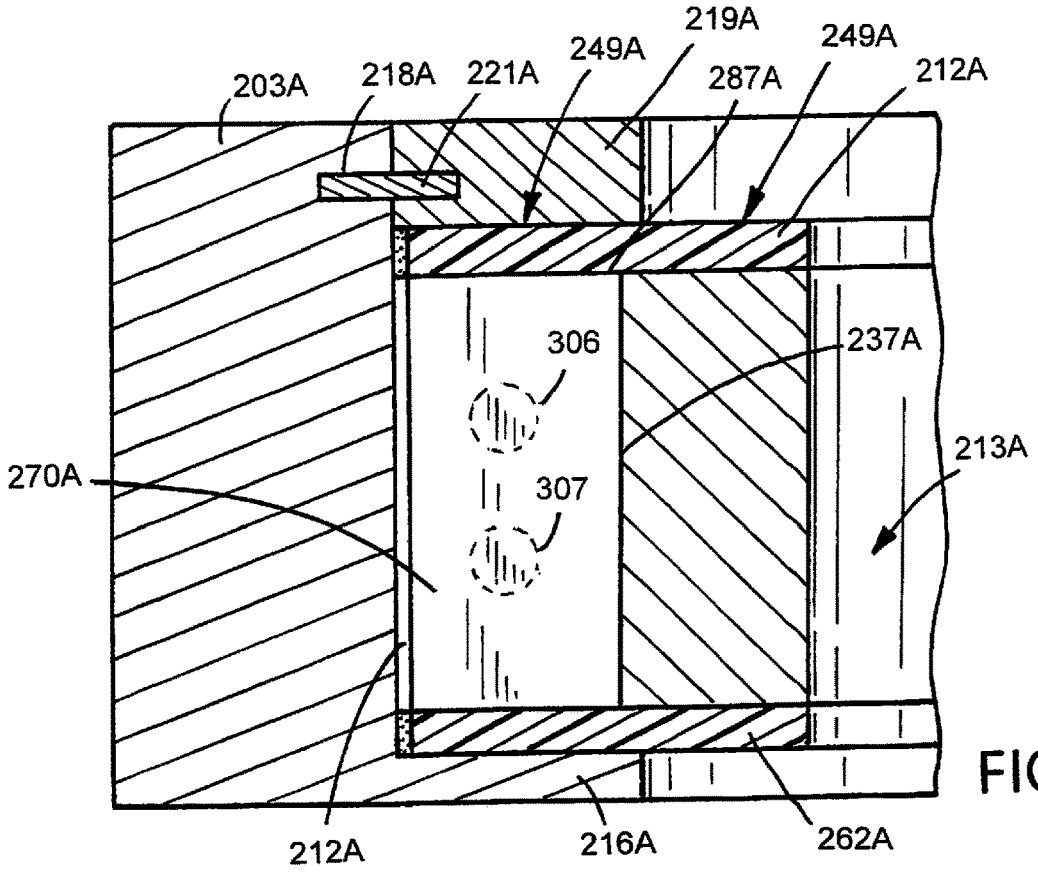
FIG. 27 is a sectional view according to FIG. 26 of a modification of the magnets for attracting the rollers.

As shown in FIG. 26, magnet 303 is located in the center of segment 270. Magnets 300, 301, 302, 304 and 305 are also located in the center of segments 273, 272, 271, 269 and 274. An alternative cage assembly has two magnets on each segment. As shown in FIG. 27, a cage assembly 249A has a segment 270A supporting two permanent magnets 306 and 307. The magnets 306 and 307 are vertically spaced on the side wall of segment 270A of cage assembly 249A. The wrench structures that correspond to the structures shown in FIG. 26 have the same reference numbers with the suffix A in FIG. 27.

Returning to FIG. 24, cage assembly segments 269 and 270 have side walls 284 and 286 on opposite sides of opening 263 that allow wedging member 251 to rotate, shown by arrow 289, and radially move from a contiguous position relative to ramp 237 and cylindrical wall 212 into wedging or driving engagement with the cylindrical wall 212 of head 203 and ramp 237 when handle 201 and head 203 are moved in a clockwise direction, shown by arrow 209, whereby torque is applied to body 213 to rotate body 213 with head 203. Wedging member 251 rolls along ramp 237 from the contiguous position in opening 263 clockwise away from the center 291 of ramp 237 to drivably couple head 203 to body 213. When head 203 and handle 201 are turned in the reverse or counterclockwise direction, shown by broken line arrow 211, wedging member 251 rotates in a counterclockwise direction, shown by broken line arrow 292, to a non-wedging or torque release position 291 whereby body 213 is not rotated. Wedging members 252 to 256 along with wedging member 251 are concurrently moved to driving wedge engagement with side wall 212 of head 203 and ramps 237 to 242 when the head 203 and handle 201 are moved in a clockwise direction to rotate body 213. When the head 203 and handle 201 are moved in a counterclockwise direction wedging members 251 to 256 concurrently move by the rotating head 203 to non-wedging or torque release positions without rotating body 213.

Preferred embodiments of the wrench have been illustrated and described. Modifications of the structure, materials and configurations may be made by persons skilled in the art without departing from the scope of the invention as defined in the claims.

The invention claimed is:

1. A wrench for rotating a fastener comprising:

a handle, a head joined to the handle, said head having an inside cylindrical wall surrounding an opening, a body located in the opening and rotatably retained on the head, said body including a wall with members engageable with a fastener for rotating the fastener, said body also including a plurality of protrusions extended toward the inside cylindrical wall of the head, each protrusion including a ramp inclined outwardly toward the inside cylindrical wall of the head, a cylindrical roller engaging each ramp and the inside cylindrical wall of the head, a cage located around the body confining each cylindrical roller to a contiguous location relative to a ramp and the inside cylindrical wall of the head, magnets subjecting the cylindrical rollers to magnetic forces for moving and holding the cylindrical rollers into engagement with the ramps and the inside cylindrical wall of the head, said cage and protrusions including cooperating members that anchor the cage on the protrusions to prevent movement of the cage relative to the body and hold the cylindrical rollers in the contiguous locations relative to the ramps and the inside cylindrical wall of the head whereby movement of the handle in one direction rotates the head and wedges the cylindrical rollers between the ramps and the inside cylindrical wall of the head and rotates the body, and movement of the handle in a direction opposite the one direction releases the wedging of the cylindrical rollers with the ramps and the inside cylindrical wall of the head and inhibits rotation of the body relative to the head.

2. The wrench of claim 1 wherein:

the cage is a non-magnetic annular member, and the magnets being permanent magnets located within the cage.

3. The wrench of claim 1 wherein:

the cage is a non-magnetic member, the cage having pockets adjacent to the cylindrical rollers, said magnets being located in said pockets.

4. The wrench of claim 3 wherein:

the magnets are permanent magnets.

5. The wrench of claim 1 wherein:

the cage is a plastic annular member surrounding the body, pockets located in the annular member, and said magnets being located in the pockets whereby the magnets move and hold the cylindrical rollers into engagement with the ramps and the inside cylindrical wall of the head.

6. The wrench of claim 1 wherein:

the magnets are retained on the body adjacent to the ramps.

7. The wrench of claim 6 wherein:

the body includes recesses in the ramps, said magnets being located in the recesses.

8. The wrench of claim 7 wherein:

the magnets are permanent magnets.

9. The wrench of claim 1 wherein:

the cage includes a cylindrical side wall having a plurality of slots, and one of said cylindrical rollers being located in each slot whereby the side wall holds the cylindrical rollers in the contiguous positions, each of said side wall having a pocket, and one of said magnets being located in the pocket.

10. The wrench of claim 9 wherein:

the cylindrical side wall has wall segments between adjacent slots, and said wall segments having surfaces located in contiguous relation relative to the inside cylindrical wall of the head.

11. The wrench of claim 1 wherein:

the cooperating members of the cage and protrusions comprise a plurality of members on the cage engageable with the protrusions to prevent movement of the cage relative to the body.

12. A wrench for rotating a fastener comprising:

a handle, a head joined to the handle, said head having an inside cylindrical wall surrounding an opening, a body located in the opening and rotatably retained on the head, said body including a wall with members engageable with a fastener for rotating the fastener, said body including ramps inclined outwardly toward the inside cylindrical wall of the head, a cylindrical roller engaging each ramp and the inside cylindrical wall of the head, an annular cage located around the body confining each cylindrical roller to a location on a ramp, magnets subjecting the cylindrical rollers to magnetic forces for moving and holding the cylindrical rollers into engagement with the ramps and the inside cylindrical wall of the head whereby all of the cylindrical rollers concurrently engage the ramps and the inside cylindrical wall of the head, and said cage and body including cooperating members that anchor the cage on the body to prevent movement of the cage relative to the body and hold the cylindrical rollers contiguous to the ramps and the inside cylindrical wall of the head whereby the rollers subjected to the magnetic forces wedge between the ramps and the inside cylindrical wall of the head so that movement of the handle in one direction rotates the head and the body, and movement of the handle in a direction opposite the one direction releases the wedging of the cylindrical rollers with the ramps and cylindrical wall of the head and inhibits rotation of the body relative to the head.

13. The wrench of claim 12 wherein:

the cage is a non-magnetic annular member, and the magnets being permanent magnets located within the cage.

14. The wrench of claim 13 wherein:

the magnets are permanent magnets.

15. The wrench of claim 12 wherein:

the cage has pockets adjacent to the cylindrical rollers, said magnets being located in said pockets.

16. The wrench of claim 12 wherein:

the magnets are retained on the body.

17. The wrench of claim 16 wherein:

the body includes recesses in the ramps, said magnets being located in the recesses.

18. The wrench of claim 17 wherein:

the magnets are permanent magnets.

19. The wrench of claim 12 wherein:

the cage includes a cylindrical side wall having a plurality of slots, and one of said cylindrical rollers being located in each slot whereby the side wall holds the cylindrical rollers in the contiguous positions, each of said side wall having a pocket, and one of said magnets being located in the pocket.

20. The wrench of claim 19 wherein:

the cylindrical side wall has wall segments between adjacent slots, and said wall segments having surfaces located in contiguous relation relative to the inside cylindrical wall of the head.

21. The wrench of claim 12 wherein:

the cooperating members of the cage and the body comprise a plurality of members on the cage engageable with the body to prevent movement of the cage relative to the body.

* * * * *